United States Patent [19]

MacDonnell et al.

[11] 4,135,833

[45] Jan. 23, 1979

[54] RAILWAY BOLSTER LUG

[75] Inventors: Robert W. MacDonnell, Crete; Otto A. Shander, Chicago Heights, both of Ill.

[73] Assignee: R. W. Mac Company, Crete, Ill.

[21] Appl. No.: 673,695

[22] Filed: Dec. 4, 1975

Related U.S. Application Data

[62] Division of Ser. No. 472,428, May 22, 1974, Pat. No. 3,924,542.

[51] Int. Cl.[2] ..... B61F 1/12; B61F 5/04; B61F 5/50; F16B 43/02

[52] U.S. Cl. ..... 403/43; 24/263 A; 105/230; 403/405

[58] Field of Search ..... 52/225; 105/226, 227, 105/228, 229, 238, 230; 403/230, 231, 256, 259, 260, 264, 43; 24/201 A, 263 A

[56] References Cited

U.S. PATENT DOCUMENTS

| | | | |
|---|---|---|---|
| 689,611 | 12/1901 | Hagemeier | 105/229 |
| 1,824,900 | 9/1931 | Kaufman | 403/231 |
| 2,716,864 | 9/1955 | Hacker | 52/225 |
| 2,974,703 | 3/1961 | Rapata | 403/231 |
| 3,482,531 | 12/1969 | Tack | 105/229 X |
| 3,915,579 | 10/1975 | Offenbroich | 403/264 |
| 3,924,542 | 12/1975 | MacDonnell et al. | 105/230 X |

*Primary Examiner*—L. J. Paperner
*Assistant Examiner*—Howard Beltran
*Attorney, Agent, or Firm*—Pope, Ballard, Shepard & Fowle

[57] ABSTRACT

Bolster re-enforcement systems, applicable both to new and existing bolster designs, provide for pre-stressing the bottom bolster center plate region utilizing lugs transmitting tension forces in opposition to the stress pattern applied to the center region of the bolster as the result of vertical loading associated with normal operating conditions.

3 Claims, 33 Drawing Figures

FIG. 1
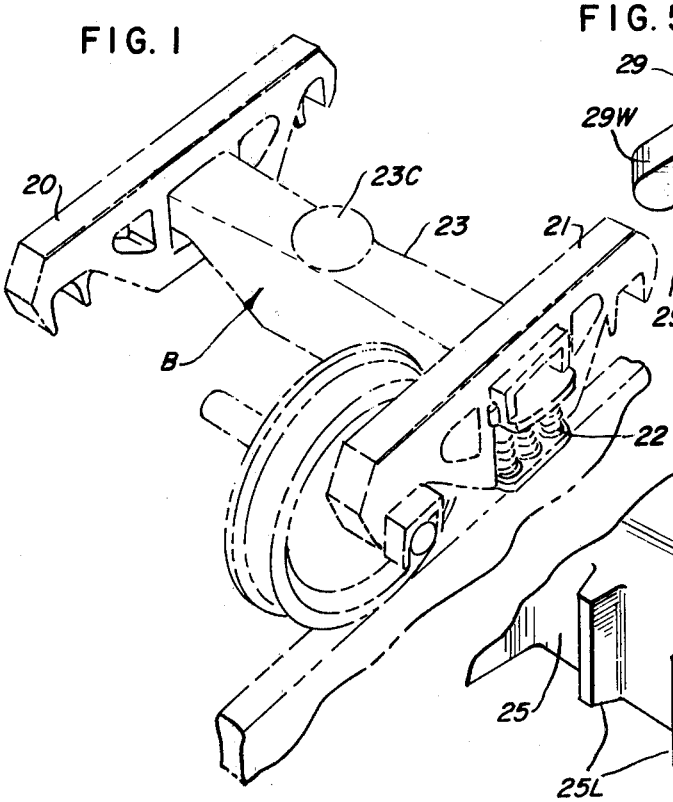
FIG. 5
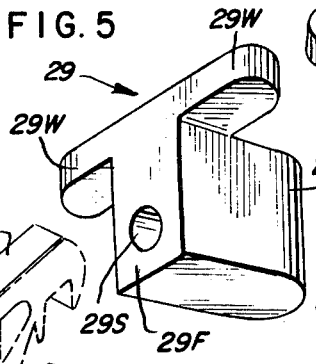
FIG. 5A
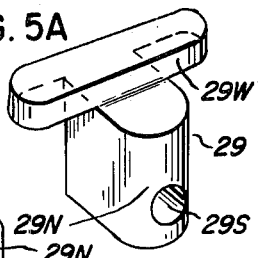
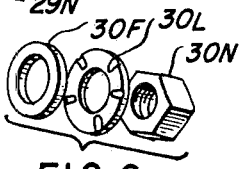
FIG. 6
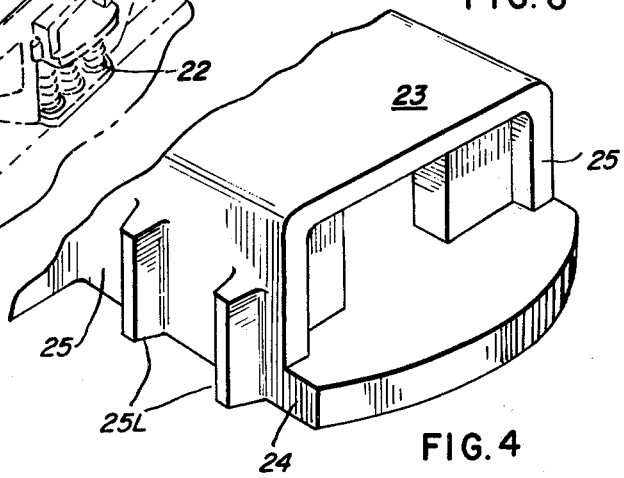
FIG. 4
FIG. 2
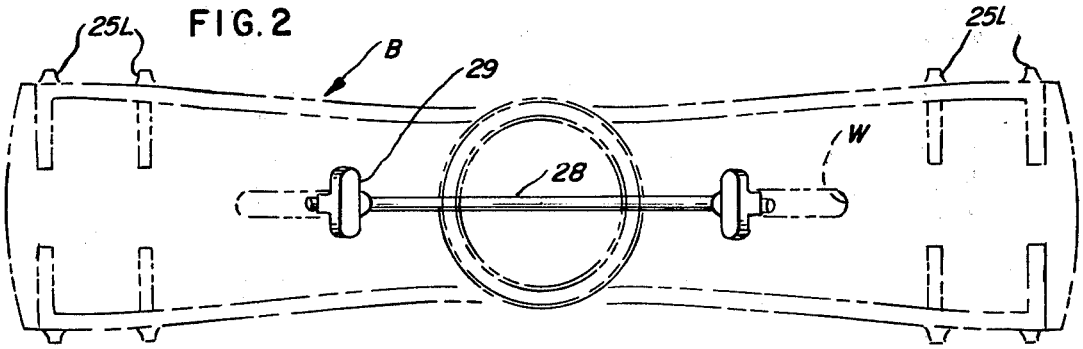
FIG. 3
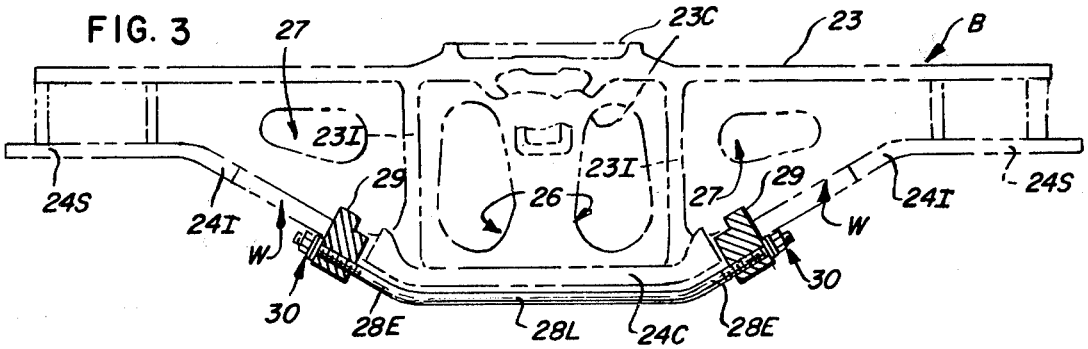

FIG. 14
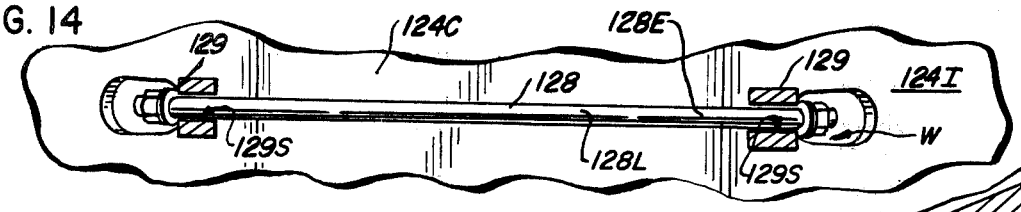
FIG. 15A
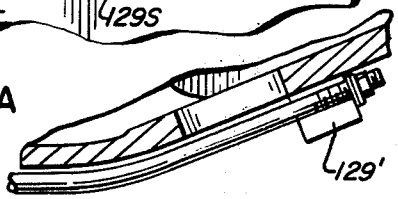
FIG. 15
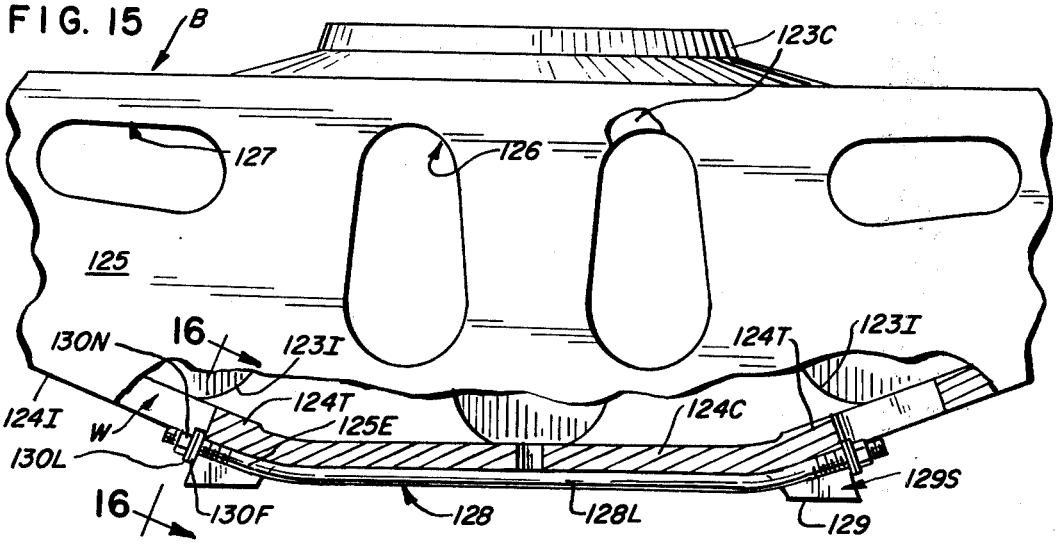
FIG. 16
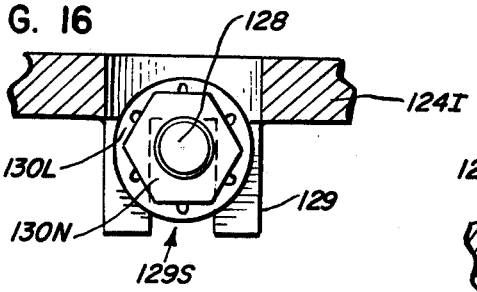
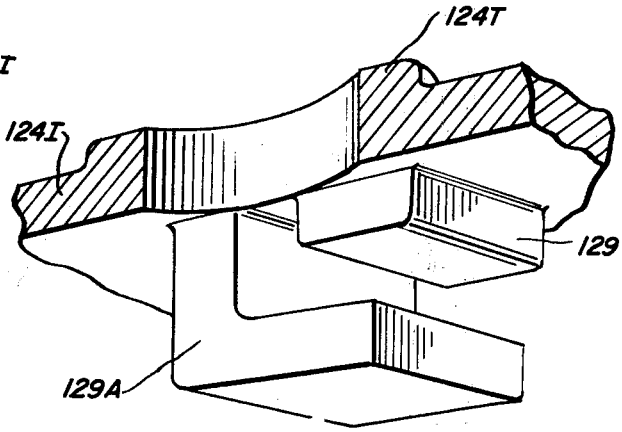
FIG. 18
FIG. 17
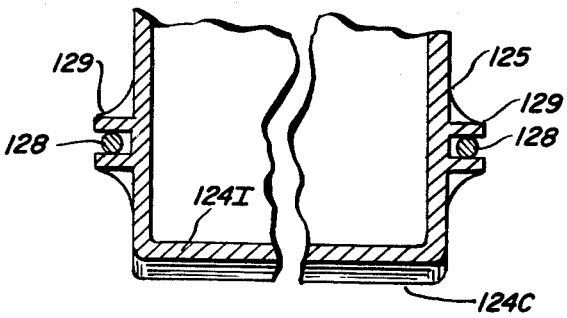

FIG. 29
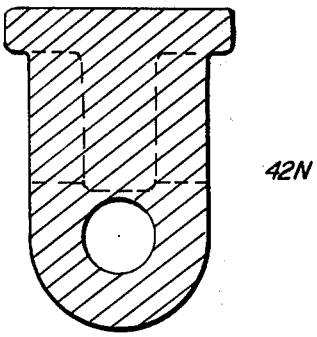
FIG. 28
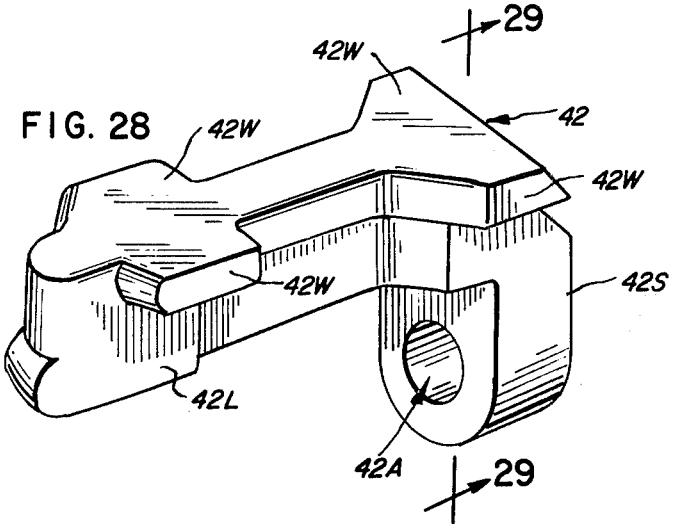
FIG. 27
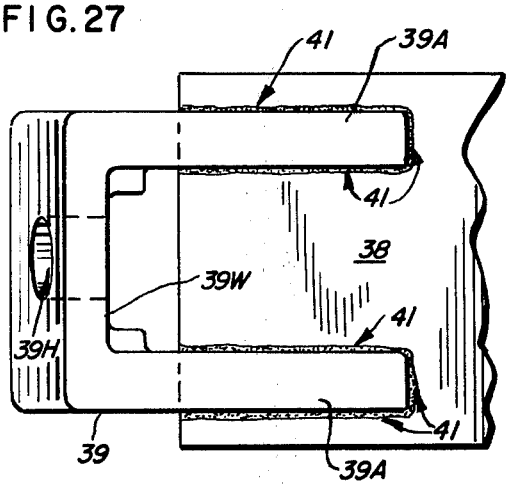
FIG. 26
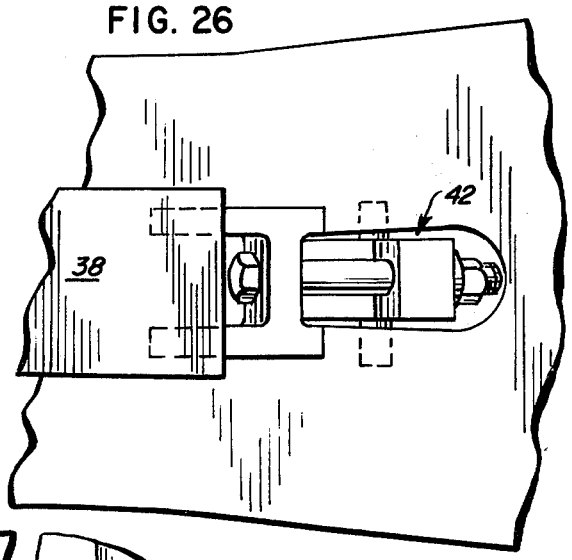
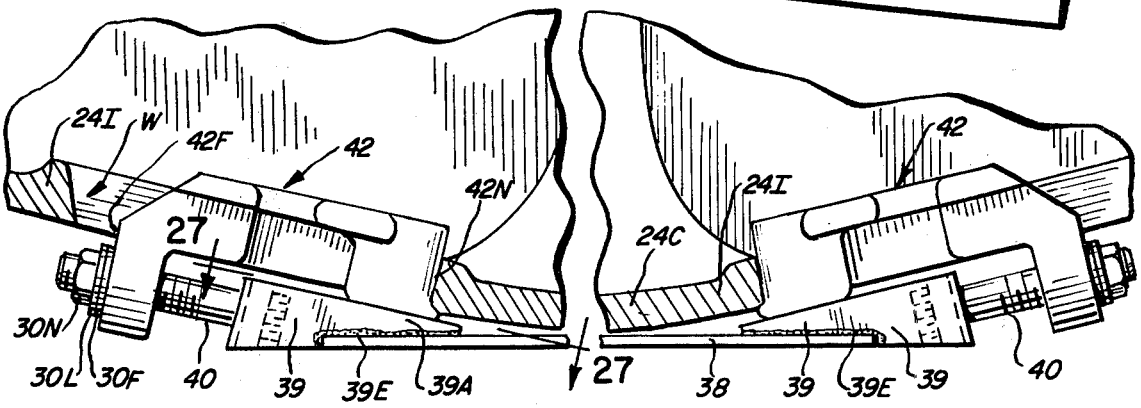
FIG. 25

RAILWAY BOLSTER LUG

RELATED APPLICATION

This application is filed as a division of pending application Ser. No. 472,428, filed May 22, 1974, now U.S. Pat. No. 3,924,542, issued Dec. 9, 1975 and entitled Railway Bolster Re-enforcement System.

BACKGROUND OF THE INVENTION

This invention relates to re-enforcement of truck bolsters against bending stresses, particularly those bending stresses resulting from conventional center plate loading under actual operating conditions.

The invention has application to improvements in the arrangement and fabrication of new bolsters and also has application to numerous types of existing bolsters. Generally speaking, the older the bolster, the more need exists for re-enforcement of the center plate area against bending stresses associated with normal operating conditions. Excessive stresses cause cracking and ultimately lead to actual breaking of the bolster.

In the case of very old bolsters, for example 20 or 25 years or more, excessive bending stresses have resulted in cracking at the lower center plate region more than at any other region. In the case of more recent bolsters, excessive bending stresses have produced cracks at the top region of the center plate more than at the bottom region. Possibly design changes incorporated in the more recent bolsters were intended to correct the crack problem at the bottom but such design changes have not removed the source of the problem of cracking.

The bolster cracking and breaking problem has accelerated in recent years and is undoubtedly aggrevated by the fact that the operating speeds have been increased, the road beds have deteriorated, and the cars frequently carry greater loads than were anticipated when the bolsters were originally built.

The seriousness of the problem of bolster cracking cannot be overstated. There are times when a bolster upon developing a crack may be continued in service either because the existence of the crack is unknown or because no replacement is available. However, in nearly every case when a crack in a bolster breaks completely through, the broken bolster parts will hang down and catch against the ties and probably cause a derailment. The seriousness of a derailment depends upon the conditions at the time when the bolster breaks but the bolster is more likely to break under high-speed, heavy load conditions than at other times.

In summary, it now appears that the most important need for re-enforcement of bolsters exists in the case of the existing bolsters, not only because present operating conditions were not foreseen at the time such bolsters were designed, but also because of the difficulty and cost of replacing the entire group of existing bolsters.

There is, in addition, an important need for identifying the real cause of bolster failures so that new bolsters may be equipped with proper facilities for minimizing the cost for providing necessary re-enforcement against excessive bending stresses.

SUMMARY OF THE INVENTION

The present invention provides for pre-stressing the bolster center plate region in opposition to the stress pattern applied to the center region of the bolster by normal loading.

Upon application of the car load through the center plate, the bolster is flexed in the fashion of a simple beam supported at its ends and subjected to a central load so that the upper center plate region is subjected to compression and the lower center plate region is subjected to tension.

Thus, the pre-stressing provided in accordance with this invention subjects the bottom center plate region of the bolster to pre-compression stress in substantial opposition to the tension which this region is subjected to under normal loading.

In the presently preferred practice of the present invention, a re-enforcement system is applied to the bottom central section of the bolster in a configuration tending to bend or bow the bolster upwardly to oppose downward bending caused by normal loading, thereby relieving the central region of substantial stresses until the normal loading greatly exceeds the pre-stressing introduced by the re-enforcement system. The re-enforcement system of this invention comprises elongated, high-strength tension means extending crosswise of the bottom center section of the bolster and anchored in lug means engaging the inclined bottom wall sections in flanking relation to the center section and means for securing the tension means under predetermined tension between the lug means for pre-compressing the bottom center section of the bolster. Where upward bowing is achieved, a vertical force is applied through the internal bolster ribs to the top center plate section of the bolster to reduce the likelihood of cracking at the top.

In the preferred embodiment, the re-enforcement system utilizes a high-strength tension means having bent ends that are adaptable to a range of inclined bottom wall angles and that enable an upward bowing pre-stressed effect while requiring a minimum of underside clearance.

In the application of the invention to the various types of existing bolsters, a number of special purpose embodiments are provided including one embodiment for minimizing underside clearance such as is required in sprung trucks and numerous embodiments utilizing various numbers and shapes for the tension means to adapt to the larger bolster sizes and to correct for the special failure modes known to exist with certain bolster designs.

The invention is also concerned with an improved new bolster design wherein lugs are formed integrally with the bolster specifically to accommodate a re-enforcement system either as part of the original installation or after the bolster has been in use for a substantial time. In the case of new bolsters, in addition to the integral lugs, the invention is concerned with the arrangement of the internal center plate ribs of the bolster for more effectively developing the upward bowing action as part of the pre-stressing pattern produced by the re-enforcement system.

For any of the embodiments described above, the re-enforcement system has the important advantage that if a crack does exist, the growth of the crack will be retarded. In addition, even if the crack were to break completely through, the bolster parts can be retained by the re-enforcement system to prevent a serious derailment.

Other features and advantages of the invention will be apparent from the following description and claims and are illustrated in the accompanying drawings which show structure embodying preferred features of the present invention and the principles thereof, and what is now considered to be the best mode in which to apply these principles.

BRIEF DESCRIPTION OF THE DRAWINGS

In the accompanying drawings forming a part of the specification, and in which like numerals are employed to designate like parts throughout the same:

FIG. 1 is a perspective view illustrating a bolster in association with the side frames of a railway car truck;

FIG. 2 is a top view showing the application of the re-enforcement system to the bottom wall of a bolster;

FIG. 3 is a side view of the bolster showing the support system in place thereon;

FIG. 4 is a perspective view of a bolster end;

FIGS. 5 and 5A are perspective views of a universal type lug utilized for securing the tension unit of this invention on the bolster;

FIG. 6 is an exploded view of a nut and washer assembly for connecting the tension unit to the lugs;

FIG. 14 is a fragmentary underneath view of an integral lug bolster re-enforcement system;

FIG. 15 is a side view partly broken away and sectioned illustrating the integral lug bolster re-enforcement system of FIG. 14;

FIG. 15A shows an alternative of FIG. 15;

FIG. 16 is an enlarged sectional view taken as indicated on the line 16 — 16 on FIG. 15;

FIG. 17 is an enlarged broken fragmentary view of the bottom central region of a bolster illustrating an alternative integral lug arrangement;

FIG. 18 is a greatly enlarged fragmentary perspective view showing another type of integral lug bolster construction;

FIG. 25 is a side view partly sectioned and broken away showing a minimum clearance external re-enforcement system on a bolster for a spring plank type truck;

FIG. 26 is a fragmentary bottom plan view of one end of the re-enforcement system shown in FIG. 25;

FIG. 27 is a fragmentary view taken approximately as indicated on the line 27 — 27 on FIG. 25;

FIG. 28 is a perspective view of the lug in the system of FIG. 25;

FIG. 29 is a sectional view taken on the line 29 — 29 of FIG. 28;

SPECIFIC DESCRIPTION

Figure 7:
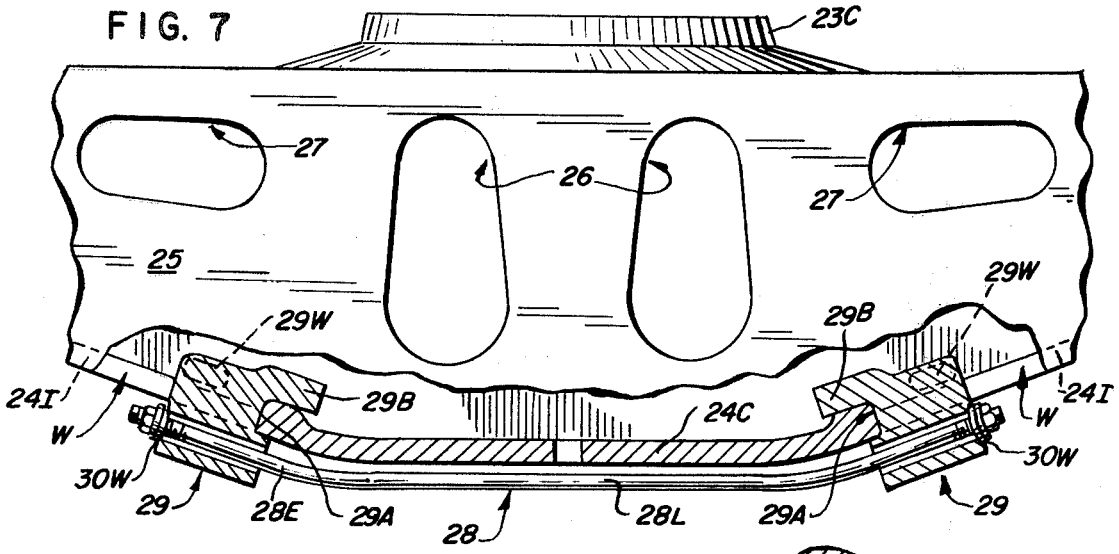
FIG. 7 is an enlarged side view, partly broken away and sectioned to illustrate another bolster re-enforcement embodiment utilizing custom lugs particularly adapted for use with ribbed type bolster window treatments.

Referring now to the drawings and particularly to FIG. 1, a conventional railway freight car truck arrangement is shown as including a pair of conventional side frames 20, 21 each having a bolster window that receives a separate spring group 22 for supporting opposite ends of a truck bolster B that extends between the side frames to support the car body.

A conventional truck bolster B, various details of which are shown in FIGS. 4 through 7 is a one-piece casting and comprises a substantially horizontal top wall 23 having a raised center plate portion 23C; a bottom wall 24 having a central horizontal portion 24C, longitudinally upwardly and outwardly angled intermediate wall portions 24I and horizontal spring seat wall portions 24S; and a pair of vertical side walls 25 extending between the top and bottom walls to collectively define an elongated hollow body having maximum depth at the center. The outer ends of the side walls 25 are shown provided with the usual pairs of lugs 25L (see FIG. 4) that flank the vertical side frame columns to guide the bolster movement.

The hollow bolster body B, in the case of the existing types, includes various arrays of internal re-enforcement ribs. Suitable coring windows for framing the internal ribs are shown at 26 and 27 in the side walls and at W in the intermediate bottom wall portions 24I. The windows 26 adjacent the center of the bolster body are arranged to accommodate brake rods.

In normal operation, the car load is applied to the top center plate section 23C and acts directly on the internal re-enforcing ribs 23I of the center plate section. Today's increased car loads and higher speeds of operation cause bolster center plate failures which usually begin as minor cracks either in the top or bottom of center plate region 23C or in the internal re-enforcing ribs 23I of the center plate or at the bottom center plate region 24C, depending upon the particular bolster design and the specific load condition. The cracks tend to begin at the bottom region 24C or in the ribs in the case of the older existing bolsters but the cracks tend to begin at the top or bottom of center region 23C in the case of the more recent bolsters wherein additional and/or stronger integral ribs were originally cast into the design.

Normal loading of the bolster causes vertical bending that places the top section including particularly the top wall of the bolster in compression and the bottom section including particularly the bottom wall in tension. The present invention concerns a bolster re-enforcement and support system that provides additional strength to the bolster center plate section by application of tension means directly across the central horizontal wall portion 24C to pre-stress the center region of the bolster substantially oppositely to the stress pattern caused by normal loading.

The re-enforcement system of the invention has the additional advantage, in the case where the bolster to which it is applied already has a crack or develops a crack, of holding the bolster together in a fashion to limit extension of the crack. In the event the bolster breaks in half, the re-enforcement system prevents the bolster halves from dropping into contact with the road bed and thus helps to avoid a serious derailment.

As is described in greater detail a number of different bolster re-enforcement and support embodiments are disclosed to illustrate both preferred and alternative embodiments and also to illustrate specialized embodiments suited to the particular needs of the various types of existing bolsters. The designs of existing bolsters differ in a number of respects which affect the design of the bolster support system. For example, the angle of incline of the intermediate bottom wall section 24I of the bolster varies from as little as a 10° angle to as much as a 30° angle. It is preferable to utilize a re-enforcement and support system design which can handle a range of bolster angles in order to minimize part inventory problems and to maximize volume production advantages.

According to the invention all of the bolster re-enforcement and support systems comprise elongated means arranged to extend across the bottom central section of the bolster (for example in FIGS. 2–10, see the elongted rod 28); lug means engaging the inclined bottom wall sections in flanking relation to the bottom central section (for example see the lugs 29 projecting from the window openings W in the inclined bottom wall sections 24I); and means are provided for securing the elongated means to the lugs (for example, see the nut and washer assemblies 30), such that the means is loaded to a pre-determined tension value thereby causing pre-compression of the bottom wall structure of the bolster.

The presently preferred embodiments as shown in FIGS. 2–10 are intended for 50 to 70 ton cars and includes elongated means 28 consisting of a single 1" diameter high strength rod, for example, 4140 heat treated steel rate at 150,000 PSI tensile. As shown the rod 28 has a bent form, in that its opposite ends 28E are bent to extend at a small angle with respect to the direction of its main length 28L. For the particular bolster illustrated, the inclined bolster walls 24I are assumed to have a 21° angle from horizontal and the rod ends 28E are bent to a 15° angle. the 15° angle makes the rod 28 applicable to bolsters having inclined walls at any angle between 15° and 30°. The 10° angle bolster structures involve special clearance requirements and are shown and described in connection with FIGS. 25 and 26.

A universal lug 29 as shown in FIGS. 5 and 5A for the embodiment of FIGS. 2 and 3 has an oversize elongated opening 29S to facilitate reception of the rod ends (for example, a 1⅛" diameter hole for a 1" diameter rod) and to allow for some differences in the angles of incline of the rod ends and the bolster walls.

The lug 29 of FIGS. 2 and 3 for a single tension rod system but is described as universal because it fits against the end of the window W for the known ribbing configurations for re-enforcement of the window W. The lug is sized to fill the width of the window W but is small enough to be inserted through the bolster openings 26, 27.

The lug 29 has crosswings 29W at its upper outboard region to overhang the side edges of the mounting window W, there being sufficient cross section at the merger of the crosswings and the main body to accommodate the forces at this region. The lug has a rounded nose 29N that seats against the inboard edge of the bolster window W to apply the main load forces developed by the support system of this invention. In the universal lug, some degree of tipping of the lug in a vertical plane occurs to adapt to any angle differences between the rod ends and the bolster walls. Accordingly, the outboard face 29F of the universal lug may be flat. One or more flat filler washers 30F and one or more load indicating washers 30L may be employed between the face 29F and a lock nut 30N. The load washers 30L have raised sections on the surface facing the lock nut 30N. If accurate torque wrenches are not available, the load indicating washers 30L can be used with feeler gauges to set the desired initial torque load.

Figure 8:
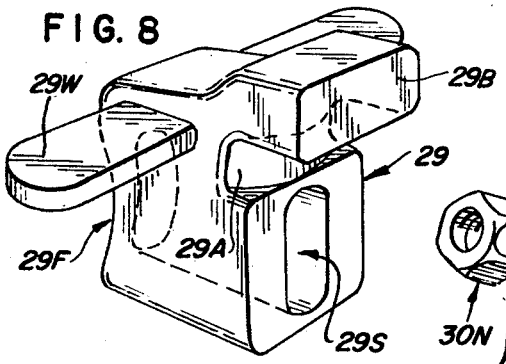
FIG. 8 is a perspective view of the lug used in the bolster re-enforcement system shown in FIG. 7.

The lugs 29 for a ribbed bolster embodiment in FIGS. 7 and 8 are provided with vertically oversize elongated slots 29S that facilitate the insertion of the rod ends and also accommodate a fixed angle rod end 28E to bolsters having inclined walls at any angle within a range from 15° to 30°. The lug 29 of FIGS. 7 and 8 has a curved outboard face 29F bordering the outer end of the elongated slot to act as a seat for a conical cast steel washer 30W that allows the rod end to adapt to various angles of the bolster walls 24I. If desired one or more filler washers 30F and load indicating washers 30L may be inserted between the conical washer 30W and the lock nut 30N.

In the ribbed bolster embodiment of FIGS. 7 and 8, the lugs 29 are generally T-shaped in end profile to present wings or shoulders 29W projecting beyond the edges of the mounting windows W. In addition, the lugs 29 have a boss 29B overhanging the enlarged inner edge of the bolster opening W and projecting towards the interior center rib structure of the bolster. An arcuate seat 29A on the lug casting engages the edge of the bolster window W. The arcuate seat 29 is curved in two dimensions, there being a vertical concave curvature enabling the lug to receive any thickness bolster wall and there being a horizontal convex curvature to mate with the curved end of the bolster window W.

The lugs 29 because of the side wings 29W and because of the presence of the boss 29B are inserted into the bolster window W by holding the lug generally transversely to the working position in which it is pictured.

To insert the lugs each lug is aligned with its wings 29W extending in the lengthwise direction of the bolster window W. The lug is then lifted upwardly until the wings 29W clear the bolster window. The lug is then rotated ½ turn and the boss 29B is tipped up into the window so that the lug may be moved inwardly to seat against the slot end. The wings 29W act as a stop to lock the lug in its working position and the boss 29B serves as a re-enforcement to retain the lug in place against downward forces that develop as a result of the interaction of the tension rod with the lug and the bolster.

Figure 10:
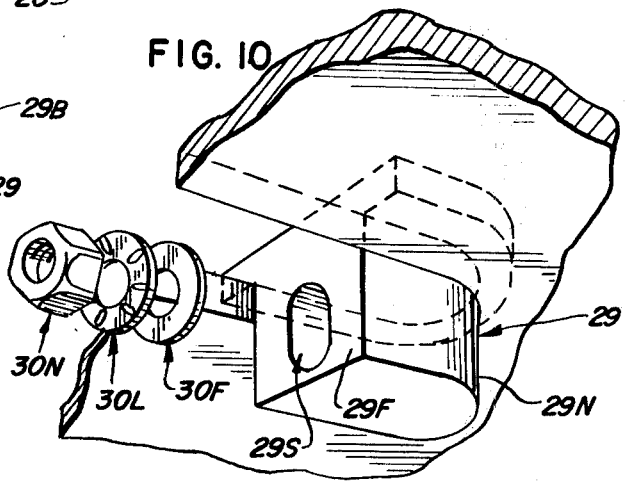
FIG. 10 is an underneath perspective view of the lug suited particularly for the non-ribbed bolster window treatment.
Figure 9:
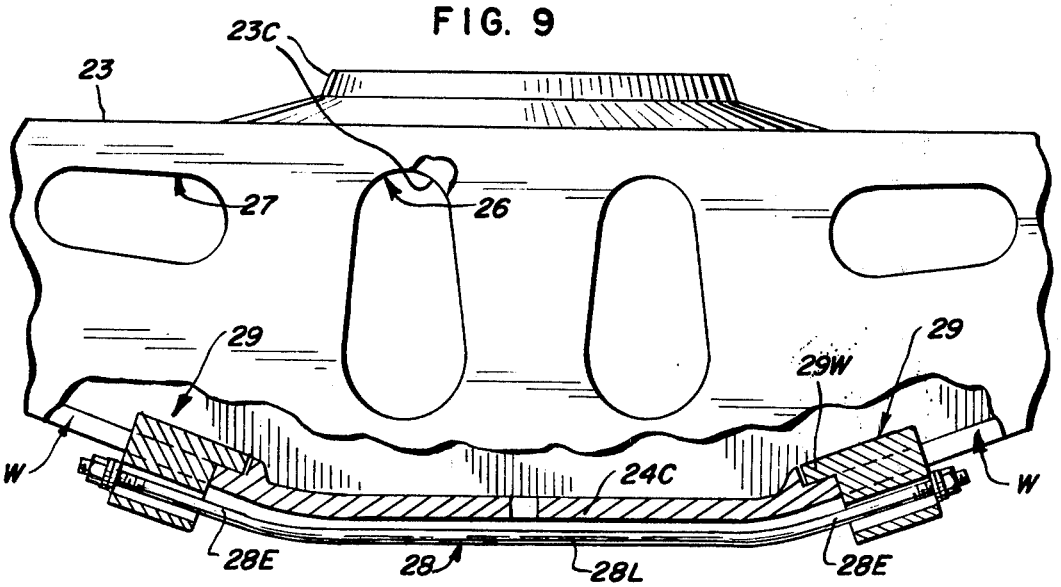
FIG. 9 is a side view showing a bolster of the non-ribbed type equipped with a bolster re-enforcement system using custom lugs.

For a non-ribbed bolster as shown in FIGS. 9 and 10, a simplified lug 29 is provided with a vertically oversize elongated slot 29S. The lug 29 has a curved nose or inboard face 29N and a flat outboard face 29F and is provided with an inboard semi-circular wing 29W that overhangs the edge of the bolster window W.

In both the ribbed and non-ribbed embodiments, the vertical slot 29S for receiving the tension rod has dimensions of about 1" in width and about 3' in height. This provides sufficient clearance to permit the bent rod to be fed through each casting slot.

It may be noted that the illustrated tension rod 28 is shown as round along its entire length; however, special rods can be utilized which are round the threaded on the bent ends 29E and flat among the main length 28L which underlies the bolster in order to minimize the clearance required for the installation. In this connection it should be noted that the design of the lug castings 29 is arranged so that the low point of the lug is at or above the bottom plane of the bolster. See FIG. 3.

From the foregoing it will be noted that the application of the bolster re-enforcement and support system using one 1" diameter tension rod 28 adds 125,000 lbs, of strength to the bolster center plate area. In addition, if the bolster has a crack, the growth of the crack is retarded by the action of the tension rod and should the bolster fail at the center plate area, the tension rod and lugs will support it against dropping on to the road bed. Nevertheless the re-enforcement system is not intended as a substitute for a bolster and the bolster should be replaced should failure occur.

It should be noted that the system can be applied to any type of truck bolster having elongated slots on the inclined bottom bolster walls, providing that no special bottom clearance requirement exists. The installation may be effected on any repair track without need for special tools and without need for welding or any modification of the bolster itself.

A special advantage of the preferred embodiment resides in the fact that the bent bolt 28, when placed under the tension, has its main length 28L in contact across the entire bottom face of the center section of the bolster while the bolt end 28E, being at a 15° angle, cause the bolt to exert an upward bending force across the bottom center of the bolster, thereby tending to reversely bow the bolster body. This type of pre-stressing pattern is substantially in opposition to that which results from normal loading applied to the bolster. Thus, the reverse bowing effect produced by the angled ends of the tension bolt not only causes pre-compression of the lower section of the bolster which is normally subjected to tension but it causes some pre-tensioning of the top section of the bolster which normally is subjected to compression. In the case of the more recent types of existing bolsters, center plate cracks are found to occur around the rim of the top or bottom of center plate section 23C. The described upward bowing effect produced by the bent bolts can produce greater strength at the top.

In addition to the bowing effect, as described, the mounting of the lugs 29 in the bolster wall openings W causes the pre-compression stress which is applied to the lower section of the bolster to be distributed laterally so that the pre-compression at the bottom is not only transmitted directly through the bottom central wall of the bolster but also through the lower regions of the side walls 25. Thus, the pre-compression stresses derived from the tension rod are distributed through all of the bolster regions that require pre-compression. It should also be noted that in addition to the upward bowing forces produced by reason of the angle of the bolt ends, some of the forces transmitted into the bottom wall by the lugs induce upward vertical stresses in the adjacent internal bolster ribs 23I to directly support the top center plate section adjacent its periphery.

Figure 11:
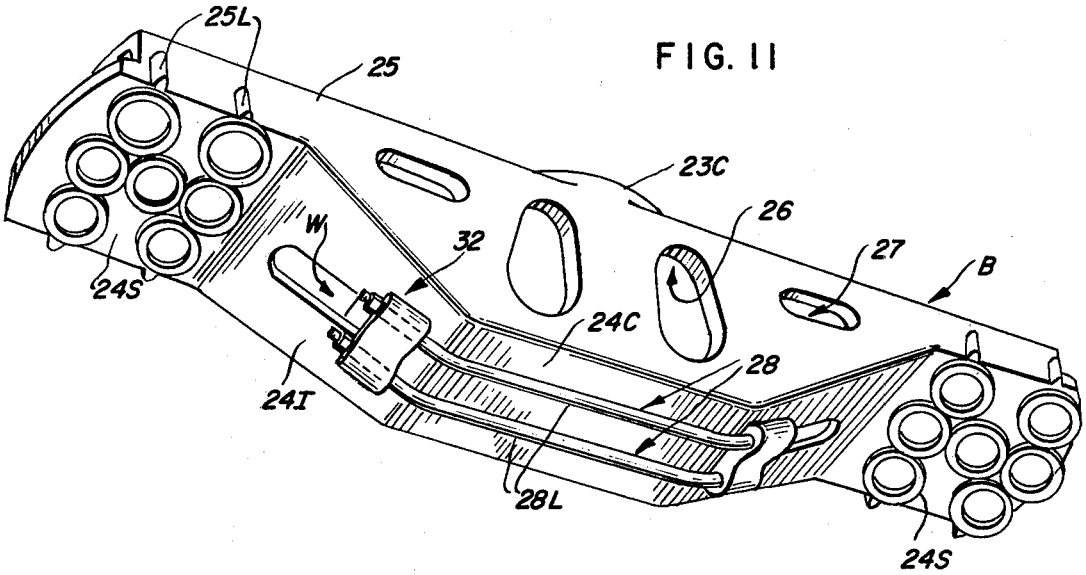
FIG. 11 is an underneath perspective view showing a double rod re-enforcement system applied to a heavy duty bolster.
Figure 12:
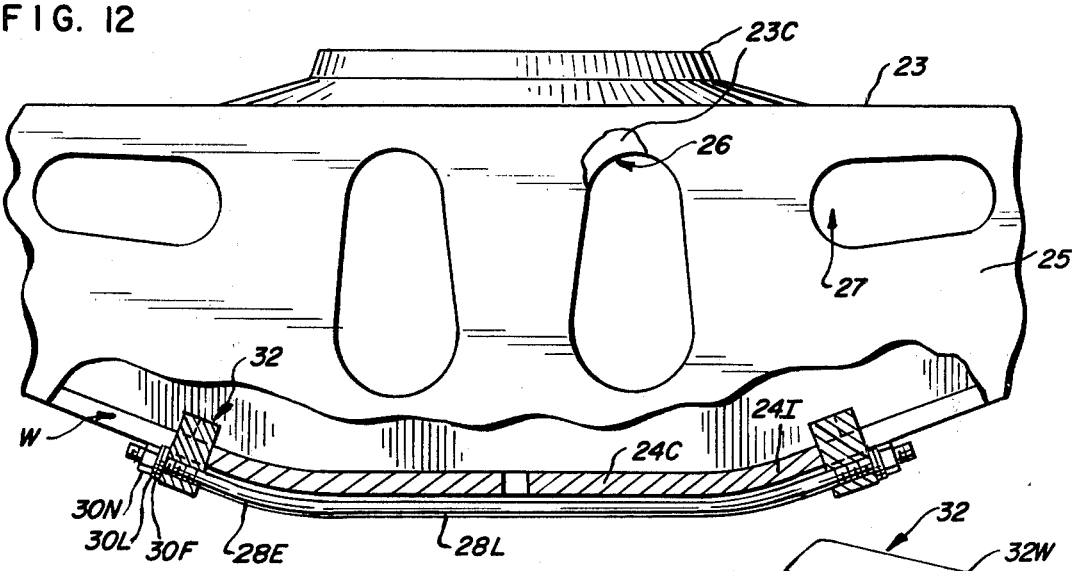
FIG. 12 is a side view of the bolster and support system of FIG. 11.
Figure 13:
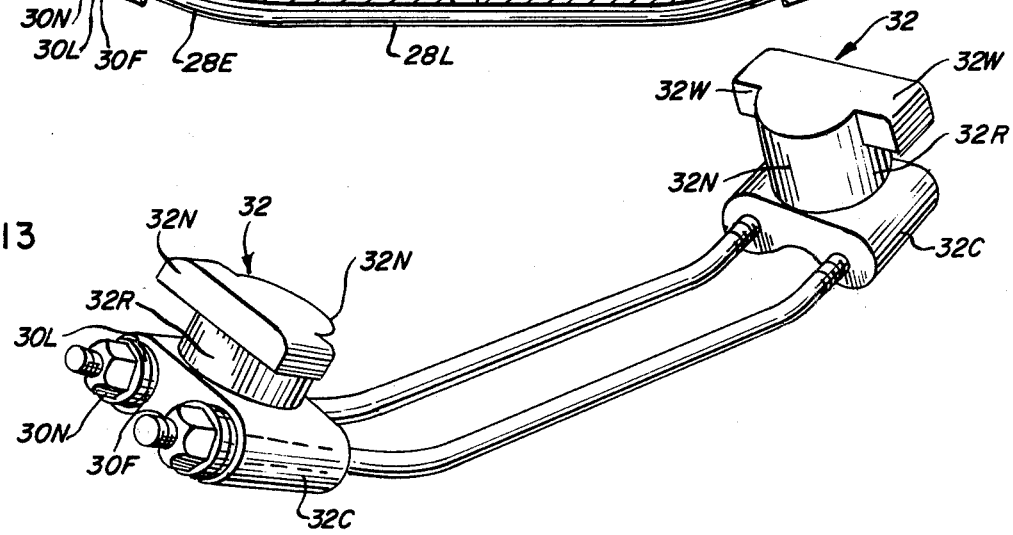
FIG. 13 is a perspective view of the double rod bolster re-enforcement embodiment of FIGS. 11 and 12.

The bolster B shown in FIGS. 11 and 12 represents a bolster of the type used in 100 ton and 125 ton cars. A bolster re-enforcement and support embodiment for the 100 and 125 ton car bolsters is shown in FIGS. 11 to 13 as including an elongated means consisting of a pair of tension rods 28 each having a main length 28L extending across the bottom center plate region 24C and bent ends 28E extending upwardly along the angled intermediate wall regions 24I.

Lug means 32 are engaged in the window openings W and have a curvilinear lower body portion 32C provided with a pair of oversize elongated openings, a reduced neck portion 32R and an irregular upper body portion providing curved nose 32N on the inboard face of the lug, and a pair of crosswings 32W extending laterally of the main body to overhang the edges of the window W. The outboard face 32F of the lug 32 is flat.

The lugs 32 are similar in their function and flexibility to the universal lugs 29 of FIGS. 2 and 3 except that each lug 32 has a pair of openings for the pair of tension rods. The lugs 32 are inserted from beneath by aligning the crosswings 32W with the window and rotating to the correct position after the crosswings are raised above the bottom wall portions bordering the windows.

As previously described, a flat filler washer 30F, a load indicating washer 30L and a lock nut 30N are applied to each projecting rod end. When all the lock nuts are fully torqued in place, a pair of 1" high strength tension rods impart an additional strength to the bolster of about 250,000 lbs. The initial load applied to the lugs is preferably at points above the bottom center region of the bolster and the tension rod directly contacts the bolster to develop an upward bowing for more fully compensating for the normal loading stresses. Typically, each lock nut is torqued to about 1,250 foot pounds. This can be done with torque wrenches or by the use of feeler gauges with the load indicating washers.

Another important aspect of the invention involves the utilization of the bolster re-enforcement and support system in the context of a newly designed bolster. Accordingly, there is shown in FIGS. 14 to 16 a new type of bolster construction particularly intended to receive an elongated tension means. The new bolster B is generally similar to existing bolsters as already described in connection with FIGS. 2 to 10 and corresponding parts bear the same reference number in the 100 series as compared with the embodiments of FIGS. 2 to 10.

It will be noted in particular that the lugs 129 for receiving the bent bolts 128 are formed integrally with the one-piece bolster and are shown to project downwardly from the inboard end of the windows W in the inclined bottom walls of the bolster, the lugs define reception slots 129S and have outboard faces serving as a seat for the filler washer 130F, load indicating washers 130L and lock nuts 130N which are torqued into place to develop the desired level of pre-compression. The slots 129S are shown open at the bottom to facilitate application of the bent rod 128 and the inclined wall of the bolster has thickened wall portions 124T bordering the sides and inner end of the bolster wall windows W in order to compensate for the localized forces resulting from the pre-tensioning of the rod 128 between the lugs 129. In addition, the internal center rib structure is modified as illustrated in that ribs 123I are shown in flanking relation to the bolster opening, such ribs having a merger line with the bolster which is slightly outboard of the location of the lugs. When the load points of the nuts 130N on the lugs 129 are higher than the lower region of the bolster the modified rib structure effects a better distribution of the pre-stress pattern resulting from the reverse bowing effect produced by tensioning of the bolts.

An alternative integral lug embodiment is shown in FIG. 15A wherein the lugs 129' are located about 1 inch outward of the outboard edge of the window opening. This arrangement requires a longer bolt but it protects a broader region of the center of the bolster. The increased span aids the overall bolster strength and is easily made possible in the case of new bolsters where the lug location may be conveniently provided on either side of the bolster window.

The integral lug bolster allows the invention to be applied at minimum cost and with maximum standardization. The invention contemplates that stress studies on new bolsters particularly concerned with optimizing the advantages of the pre-stress feature of this disclosure may show a new for additional bolster modifications.

A number of other lug arrangements particularly for integral lug bolster designs are also contemplated. For example, integral lugs 129 are shown on lower regions of the side walls 125 in flanking relation to the lower bolster center plate region 124C to accommodate a pair of tension rods 128 in FIG. 17.

Instead of the parallel integral lugs 129 that allow for vertical insertion of the bent tension rod, as shown in FIG. 16, an angled lug 129A in combination with a straight lug 129 can be used as shown in FIG. 18 to provide for lateral insertion of the tension rod. Newly constructed integral lug bolsters facilitate matching of the bolster wall angles and the tension rod angles to permit accurate close fit mountings.

Figure 19:
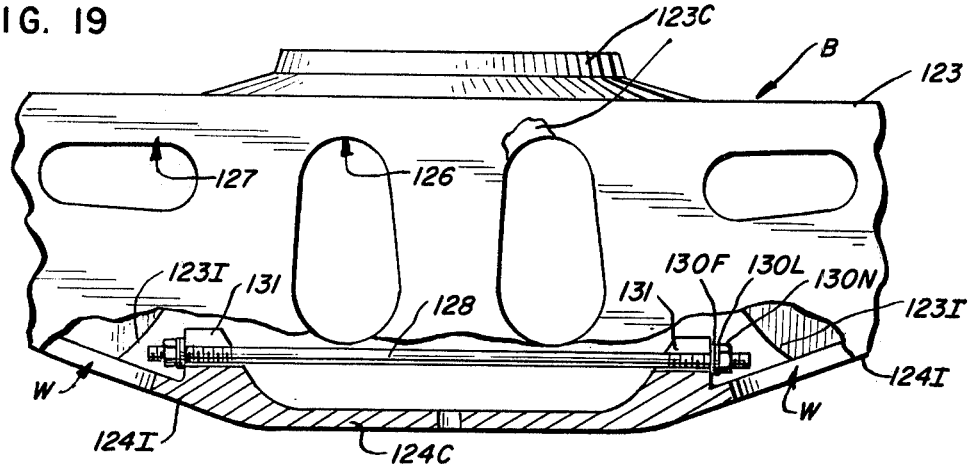
FIG. 19 is a side view partly broken away and sectioned illustrating an internal integral lug, straight support rod re-enforcement system in accordance with this invention.
Figure 20:
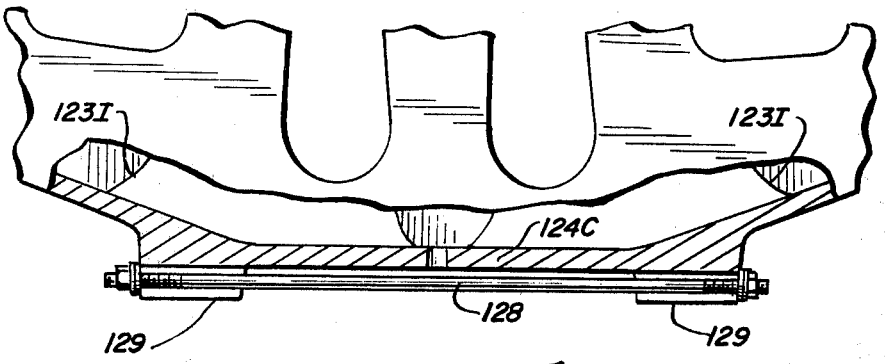
FIG. 20 is a similar side view broken away and sectioned to illustrate an external integral lug, straight support rod re-reforcement system in accordance with this invention.

Other integral lug bolster embodiments are shown in FIGS. 19 and 20. In the arrangement of FIG. 19, pairs of parallel integral lugs 131 project upwardly of the inclined bottom wall portions 124I at points bordering the inboard ends of the bolster windows W. The lugs 131 are shown with flat faces for the washers 130F, 130L and the nuts 130N and the tension rod 128 is shown extending straight through the lower interior region of the bolster. Some of the present day bolster designs have clearance at this region of the bolster so that interior rib arrangements that are practical for this application are already known.

When the rod 128 shown in FIG. 19 is tensioned by torquing the nuts 130N the pre-compression pattern is somewhat different because the main length of the rod is not applying a vertical force at the bottom center region 124C of the bolster. It is therefore desirable that the interior ribs 123I be arranged to increase the direct transmission of the preload forces to the upper center plate region 123C.

Another integral lug bolster embodiment is shown in FIG. 20 where the pairs of parallel integral lugs 129 project downwardly somewhat like the lugs shown in FIG. 15. In FIG. 20, however, the lugs 129 are located closer to the center region 124C and extend to a lower elevation to receive a straight tension rod 128. This arrangement leaves less clearance beneath the bolster and does not produce the upward force of the tension rod against the center region 124C but it effectively pre-compresses the center region 124C to improve the bolster's overall ability to withstand normal vertical loading without cracking and breaking.

Figure 21:
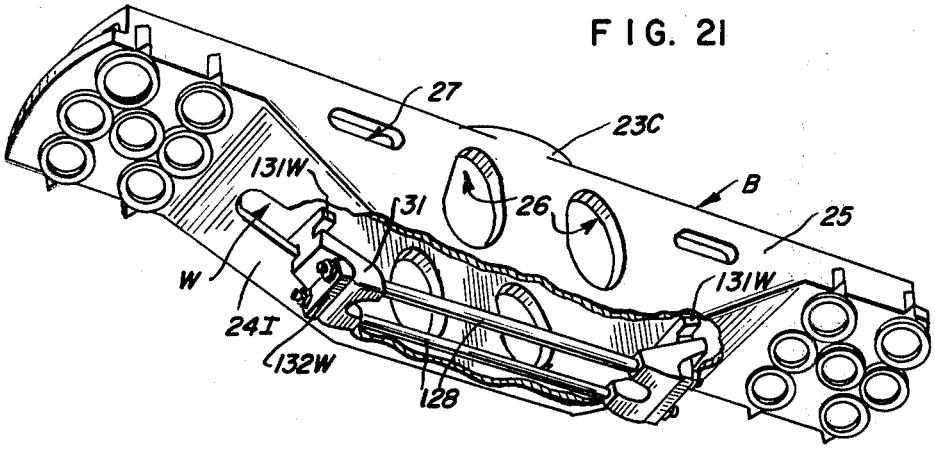
FIG. 21 is an underneath perspective view of a multiple straight support rod re-enforcement system applied to a heavy duty bolster by separate lugs.

Multi-rod bolster re-enforcement and support systems for application to existing bolsters are shown in FIGS. 21 to 24. in FIG. 21, the bolster B is shown equipped with lugs 31 generally similar to the lug 29 shown in FIG. 8 except that each lug 31 has a pair of elongated openings located beneath the bottom plane of the bolster to receive a pair of straight tension rods 128. Thus, each of the lugs 31 has an inboard overhanging nose or boss and crosswings 131W that are inserted in the fashion described in FIG. 8. The outboard face of the lug is concave to serve as a seat for an arcuate double washer 132W which has a flat outboard face 132F to accommodate load indicating washers and lock nuts.

Figure 22:
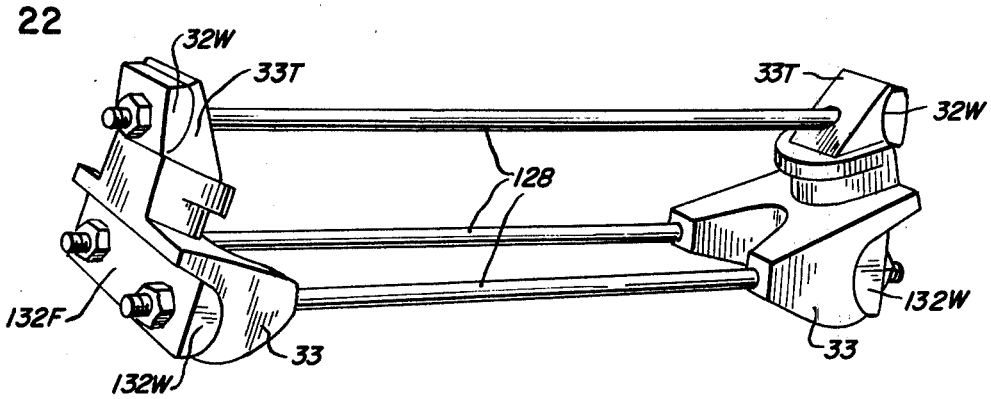
FIG. 22 is a perspective view of a triple support rod system wherein one of the rods is interior of the bolster.

A three rod bolster re-enforcement and support system is shown in FIG. 22 wherein each of the lugs 33 are similar to the lugs 31 shown in FIG. 21 except no crosswings are used (the corresponding parts being identified by the same reference numerals) and, in addition, each lug includes a top extension 33T having a concave seat for an arcuate washer 32W to provide for mounting the third rod 128 to extend across the lower center region internally of the bolster.

Figure 23:
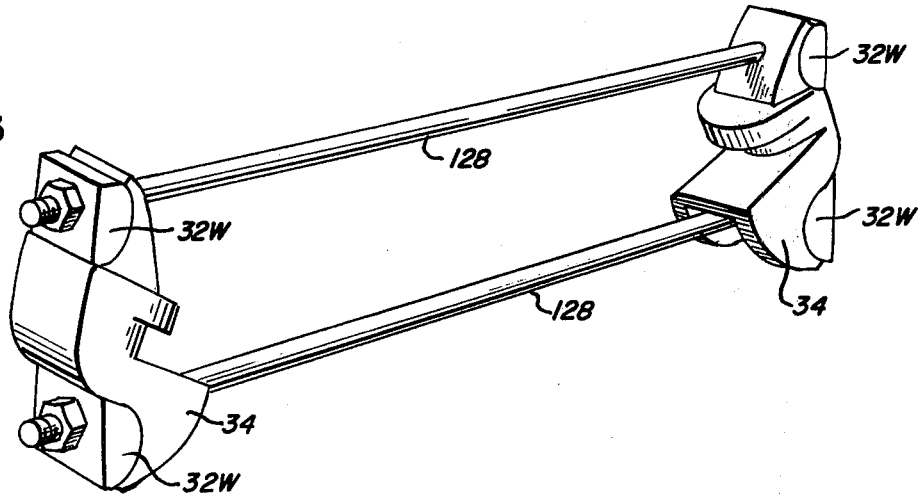
FIG. 23 is a perspective view of a double support rod system wherein one of the rods is interior of the bolster.

Another combination tension rod arrangement is shown in FIG. 23 wherein the lug 34 is of the same general type as shown in FIG. 22 but has its lower section arranged to receive only a single tension rod. Thus, the embodiment in FIG. 23 has one internal tension rod 128 and one external tension rod 128.

In the combination internal-external embodiments of FIGS. 22 and 23 each tension rod may be torqued to the same value or a preferential torquing arrangement may be utilized wherein the external rods are torqued to the typical values previously given for producing the primary pre-compression effect while the internal tension rod is torqued substantially less so as to serve not primarily for pre-compression but for providing additional normal load handling capacity at the lower bolster center region.

Figure 24:
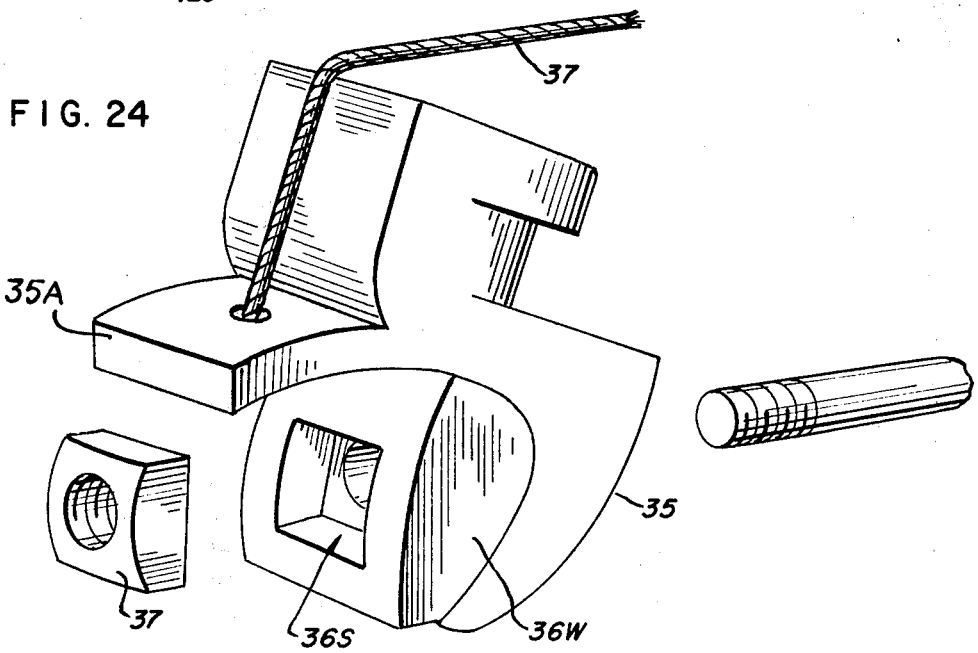
FIG. 24 is an exploded perspective view illustrating another lug construction.

Another lug configuration as shown at 35 in FIG. 24 may be utilized with the bolster support systems intended for existing bolsters. In this arrangement arcuate washer 36W has a counter sunk socket 36S for receiving a square lock nut 37 to show that where the tension rods are straight across the bottom of the bolster the pre-compression torquing may be applied from one end only by the use of counter sunk nuts in the lug at the opposite end such as is shown in FIG. 24.

In addition, the lug arrangement shown in FIG. 24 has an apertured tail portion 35A serving as an anchor for a safety sling 37 which is connected through the bolster to retain the parts with the bolster in the event a lug casting should break under unusual loading conditions.

In some instances the bolster mounting clearances are severely restricted such that a one inch diameter rod in contact with the underface of the bottom center region of the bolster cannot be accommodated. Such a situation is encountered in the case of a sprung truck, that is a truck which includes a spring plank. A bolster re-enforcement and support system, particularly useful for the lower clearance spring plant type bolster mounting environment is shown in FIGS. 25 to 27 wherein the tension unit consists of a flat plate 38 having its opposite ends secured to end castings 39 which are arranged to receive projecting cap screws 40 that serve as the counterpart to the rod ends of the bent rod embodiments.

To provide equivalent strength to that achieved with the one inch diameter tension rod the flat steel plate 38 is 5 inches wide and ¼" thick and is arranged to extend across the underface of the bottom center region 24C of the bolster and sufficiently therebeyond to afford clearance for the end castings 39. Each end casting 39 had an apertured main cross wall 39W provided with an oversize hold 39H, for example, a 1-3/16" diameter hole to receive the threaded end of the cap screw 40 at various angular orientations to adapt the tension unit to bolsters having walls of various angular incline. Each of the end castings 39 has parallel attachment arms 39A extending therefrom and provided with notched edges 39E that receive the end of the steel plate. The end castings are welded to the plate so that the weld region 41 is at least as strong as the main section of the plate 38. For this purpose each of the end castings has contact with the plate, a distance of 3¼" along each side of each attachment arm 39A to make a total of 14" of continuous ¼" weld plus a fillet weld across each end of each arm 39A. The arms are shown herein being ⅝" wide.

The lugs 42 for receiving the threaded ends of the cap screws 40 are of angular generally L-shaped profile, having a short leg 42S provided with an oversize aperture 42A that receives the threaded cap screw stud. The long leg 42L of each lug has a rounded nose 42N for broad surface engagement with the inboard edge of bolster window W and it includes crosswings 42W to overhang the edges of the wall portions that border the bolster window W to retain the lug in place. The underface of the long leg of the lug has a stepped profile so that the inboard or nose end thereof is located immediately adjacent the upper face of the corresponding end casting 39. These parts being engagable under load and tending to remain in the position as originally installed by reason of their interengagement. As indicated previously, the projecting end of the studs are provided with a filler washer 30F engagable against a flat outboard face 42F on the short leg of the lug, a load indicating washer 30L and a lock nut 30N.

The size and shape of the lugs 42 is such that they may be inserted either from the top or the bottom of the bolster. The arrangement is such that the plate 38 is substantially planar so that it contacts the central lower region 24C of the bolster and projects sufficiently along the inclined bolster walls 24I to extend beyond the inboard edge of the windows W. At that location there is sufficient clearance to accommodate the generally triangular shaped end castings 39 that receive the cap screws. The lugs 42 in this form are universal in that they are adaptable both to ribbed and non-ribbed bolster window treatment, the lugs being elongated to insure that the connection of the tension unit is accomplished without any part projecting beneath the elevation of the plate.

Tests of the re-enforcement system of FIGS. 25, 26 on a conventional 5½ × 10, 50 ton bolster having a minimum static load requirement of 423,500 lbs. per AAR specifications showed that the re-enforced bolster carried a load of 632,000 lbs. and failure finally developed at a location outboard of the lugs 42.

Figure 30:
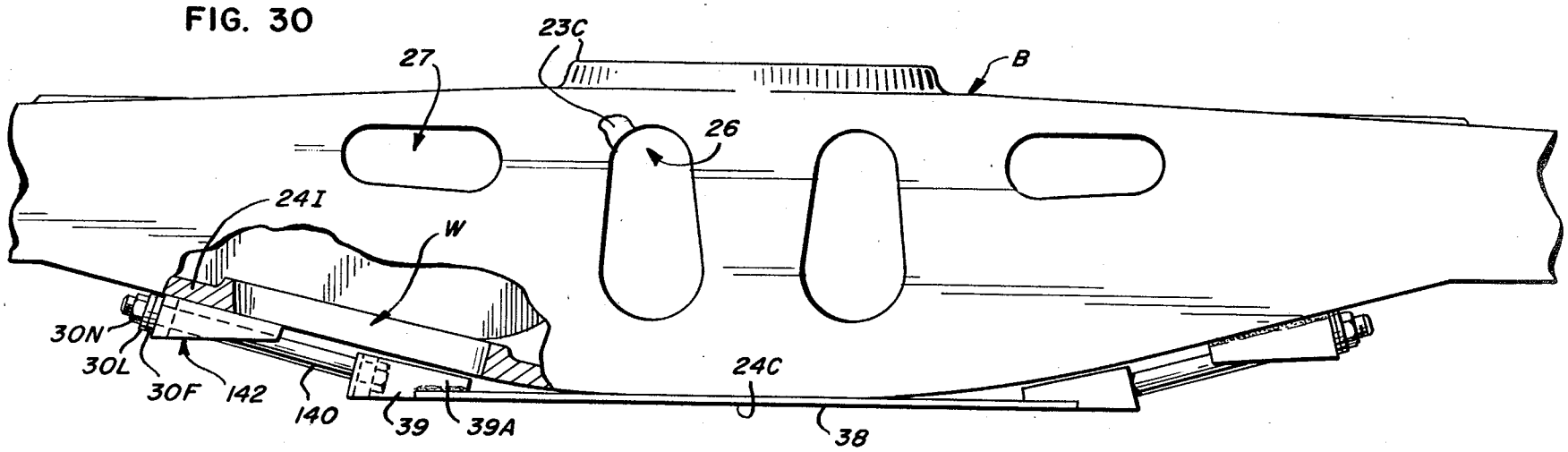
FIG. 30 is a side view partly in section and broken away showing an alternative embodiment of a minimum clearance system similar to the FIG. 25 arrangement.
Figure 31:
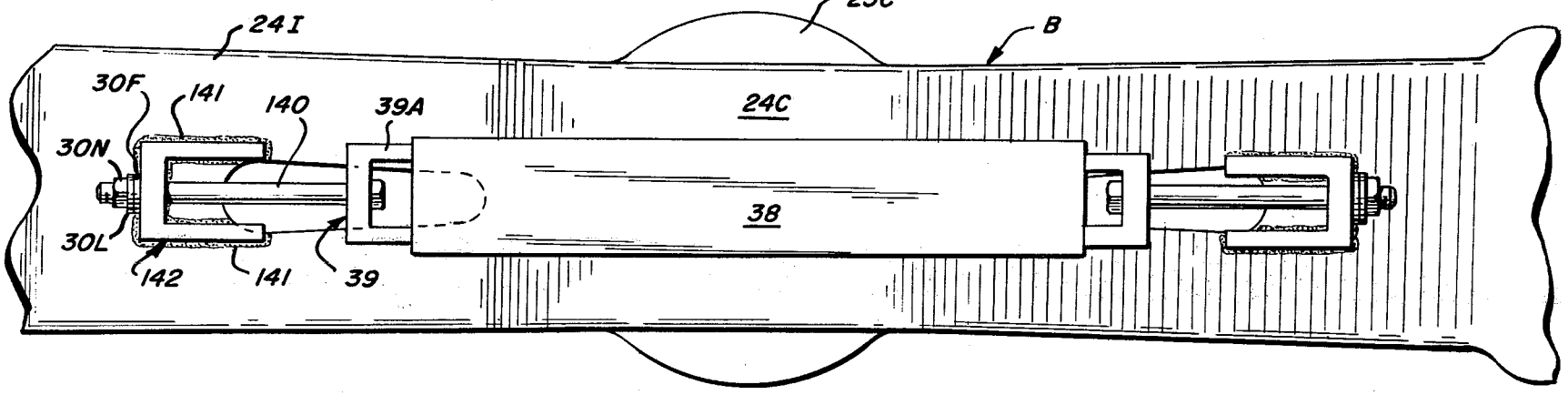
FIG. 31 is a fragmentary plan view of the re-enforcement system shown in FIG. 30.

A modified re-enforcement system for sprung trucks is shown in FIGS. 30 and 31 where the points of attachment to the bolster are located outboard of the windows W. These outboard points of attachment develop prestressing both across the center plate area and across the secondary window areas that are of reduced section by reason of the provision of the window openings 27, W.

The system of FIGS. 30 and 31 may be identified to the system of FIGS. 25 and 26 (corresponding parts being identified by the same reference characters) except that the welded attachment lugs 142 replace the angled lugs 42 and longer bolts 140 are used in place of the bolts 40. The lugs 142 shown herein are identical to the end castings 39 and are secured to the underface of the bolster by lines of weld 141 to provide a total weld length equal to or greater than that of the weld lines 41.

The mounting location of the welded lugs 142 is best shown in FIG. 31 and it should be noted that the prestress forces are introduced into the inclined bolster walls 24I at locations that are largely outward of the outboard edges of the windows W.

The result is that the bolster is re-enforced by prestressing substantially from spring seat to spring seat. The higher elevation of the points of attachment of the lugs 142 enhances the upward bowing effect of the re-enforcement system.

If desired, the bolster may be heat-treated after the welding of the lugs 142 to relieve any thermally reduced stresses at the weld region.

It is also contemplated that the welded lugs 142 or modifications thereof can be used with the bent bolt embodiments of FIGS. 2, 7 and 11, the only change being to use bolts sufficiently long to span the greater lug spacing and to provide bolt holes large enough to facilitate insertion of the ends of the bent bolts.

In addition the integral lugs 129' shown in FIG. 15A should also be understood to be representative of the welded lug embodiment.

Thus, while preferred constructional features of the invention are embodied in the structure illustrated herein, it is to be understood that changes and variactions may be made by those skilled in the art without departing from the spirit and scope of the appended claims.

What is claimed is:

1. A lug for compression engagement with an inboard bolster edge region bordering a window opening in an inclined intermediate bottom wall portion of a bolster, said lug comprising an elongated main body with at least one passage having an axis extending therethrough, an outboard surface perpendicular to the axis of said passage at one end thereof for receiving compression forces and transmitting the same in distributed relation therethrough, and an inboard face contour providing a convexly contoured surface portion above the other end of said passage perpendicular to said axis to distribute said compression forces.

2. A lug as defined in claim 1 wherein said main body has wings projecting laterally from upper regions thereof, perpendicular to said axis of said passage.

3. A lug as defined in claim 1 wherein said main body has a pair of parallel side-by-side passages with substantially parallel axes.

* * * * *